US008011140B2

(12) United States Patent
Durham

(10) Patent No.: US 8,011,140 B2
(45) Date of Patent: Sep. 6, 2011

(54) INFORMATION DISPLAY SHELTER

(76) Inventor: Steven Durham, Ponte Vedra Beach, FL (US)

( * ) Notice: Subject to any disclaimer, the term of this patent is extended or adjusted under 35 U.S.C. 154(b) by 701 days.

(21) Appl. No.: 12/044,715

(22) Filed: Mar. 7, 2008

(65) Prior Publication Data

US 2008/0216418 A1 Sep. 11, 2008

Related U.S. Application Data

(63) Continuation-in-part of application No. 10/679,075, filed on Oct. 3, 2003, now abandoned, which is a continuation-in-part of application No. 09/902,390, filed on Jul. 10, 2001, now Pat. No. 6,631,591.

(51) Int. Cl.
*E04B 9/32* (2006.01)

(52) U.S. Cl. ..... 52/73; 52/74; 135/90

(58) Field of Classification Search ..... 52/73, 74, 52/28, 173.3; 135/90, 20.1, 21; 248/122.1; 136/244, 245, 251, 291
See application file for complete search history.

(56) References Cited

U.S. PATENT DOCUMENTS

| | | | | |
|---|---|---|---|---|
| 2,926,678 | A * | 3/1960 | Francis | 135/90 |
| 4,281,369 | A | 7/1981 | Batte | |
| 4,592,436 | A * | 6/1986 | Tomei | 180/2.2 |
| 5,107,637 | A * | 4/1992 | Robbins | 52/28 |
| 5,109,643 | A * | 5/1992 | Speers | 52/91.3 |
| 5,149,188 | A * | 9/1992 | Robbins | 362/183 |
| 5,261,435 | A * | 11/1993 | Stanley et al. | 135/90 |
| 5,510,828 | A | 4/1996 | Lutterback et al. | |
| 5,692,647 | A * | 12/1997 | Brodie | 222/173 |
| 5,772,311 | A | 6/1998 | Williams et al. | |
| 5,847,537 | A * | 12/1998 | Parmley, Sr. | 320/109 |
| 5,998,963 | A * | 12/1999 | Aarseth | 320/109 |
| 6,727,809 | B1 | 4/2004 | Smith | |
| 7,206,044 | B2 | 4/2007 | Li et al. | |
| 7,596,602 | B2 * | 9/2009 | Ellman | 709/206 |
| 2001/0051900 | A1 * | 12/2001 | Fisher et al. | 705/26 |
| 2003/0119447 | A1 * | 6/2003 | Fisher et al. | 455/41 |
| 2004/0004844 | A1 * | 1/2004 | Ryan, Jr. | 362/545 |
| 2004/0261955 | A1 * | 12/2004 | Shingleton et al. | 160/84.06 |
| 2005/0109384 | A1 * | 5/2005 | Shingleton et al. | 136/244 |

(Continued)

FOREIGN PATENT DOCUMENTS

JP 08019193 A * 1/1996

(Continued)

OTHER PUBLICATIONS

Fremont Street Experience Brings Downtown Las Vegas into Next Century.*

(Continued)

*Primary Examiner* — Brian E Glessner
*Assistant Examiner* — Beth Stephan

(57) ABSTRACT

An information display shelter includes at least a canopy, a supporting structure, a receiving device, and a signaling path. The canopy includes a display area on at least one surface thereof. The supporting structure is connected to and supports the canopy over a sheltered area defined by a width and a length of a parking space. The supporting structure is configured so as to permit substantially unobstructed access to the sheltered area and viewing of the display area. The receiving device is operable to receive and process a signal including images to be displayed. The signaling path couples the receiving device to the canopy and facilitates communication of the images to the canopy for display in the display area.

8 Claims, 7 Drawing Sheets

U.S. PATENT DOCUMENTS

2010/0029268 A1 2/2010 Myer et al.

FOREIGN PATENT DOCUMENTS

JP 11303439 A * 11/1999
JP 11303440 A * 11/1999
JP 2002194912 A * 7/2002

OTHER PUBLICATIONS

Fremont Street Experience—Wikipedia, the Free Encyclopedia.*
Young, "Illuminating the Issues Digital Signage and Philadelphia's Green Future" Online Article available at Scenic America Website (c2010).
Annual Report by Environmental Chapter "Noise, Light Pollution, and Visual Pollution" accessed at http://www.docstoc.com/docs/22931940/Noise-Light-Pollution-and-Visual-Pol, Dec. 2001.
Scenic America Website and Associated Articles available at http://www.scenic.org/billboards/safety. (c) 2010 by Scenic America. USA.
AVTechnology Website and Associated Content available at http://avtechnologyonline.com/article/52368.aspx (c2010), USA.
Gordon & Rees (Lawyer's Website) Article (c2011) accessed at http://www.gordonrees.com/results/viewResult,cfm?contentID=1180.

* cited by examiner

INFORMATION DISPLAY SHELTER

CROSS-REFERENCE TO RELATED APPLICATIONS

This application is a continuation-in-part of U.S. application Ser. No. 10/679,075 filed Oct. 3, 2003 (now abandoned), which was a continuation-in-part of U.S. application Ser. No. 09/902,390 filed Jul. 10, 2001 (now U.S. Pat. No. 6,631,591), and hereby claims priority to and based upon said prior applications under 35 U.S.C. §120, the full disclosures of said applications being incorporated herein by reference.

TECHNICAL FIELD

The present invention relates to a canopied shelter, such as a carport shelter, and more particularly to a shelter that displays electronically received information on one or more surfaces (e.g., an underside surface) of the shelter's canopy.

BACKGROUND OF THE INVENTION

A need exists for a shelter that protects vehicles from natural environmental concerns while still providing an unobstructed view of the vehicles.

A need also exists for a shelter that reduces the amount of sun, UV rays, rain, hail, light snow and other elements that possibly could make contact with vehicles, yet also remains aesthetically pleasing, complements the surroundings, and allows the car to be on display.

In addition, a need exists for a shelter suited for people that do not desire to keep their vehicles in a garage or other enclosed structure, but still want to keep them sheltered, particularly without significantly obstructing the natural view of the surrounding environment. A need further exists for a carport or shelter that is capable of producing electricity when exposed to sunlight or artificially generated light.

A need further exists for a carport shelter-display that is capable of protecting people and vehicles from the elements while also being able to display video, text, graphics, and other images and information to users of the shelter or others.

SUMMARY OF THE INVENTION

In accordance with the present invention, a shelter, which may be a carport, is provided. The shelter can include either a semi-flexible or tensioned/membrane roof, that can be in the shape of a rigid, concave canopy, or any other desired shape that is composed of a rigid self-supporting material. Consequently, the canopy in one embodiment can be a frame-less structure, that is, a frame to support the canopy is not required. The canopy can be of any desired size or area and typically has a width and length larger than the width and length of a standard size automobile. The shelter typically further includes a suitable supporting structure that rigidly connects to the canopy, so that the canopy is mounted in a fixed position spaced above the ground a desired distance. Preferably, the shelter structure in accordance with the invention includes a longitudinally extending support member rigidly secured to the canopy and to a laterally, generally horizontally extending supporting structure that has an end or a portion that is laterally spaced from the canopy. The end or portion of the laterally extending supporting structure that is laterally spaced from the canopy can be secured to another structure that provides the desired elevation for the rigid canopy. Typically, that structure will be a generally vertically extending post member mounted directly or indirectly to the ground, or to other suitable structure.

In accordance with one aspect of the invention, a rigid, concave canopy is provided that is composed of light transmissive material which may be transparent or translucent. In another embodiment, it is composed of transparent, colored or opaque material, which may include a one-way mirrored material, on either side and typically so that a person below the canopy can see upward through the canopy, but a person above the canopy cannot see downwardly through it. Thus, it is contemplated that in one embodiment the canopy will provide for a substantially unobstructed view of both the vehicle underneath it and the surrounding environment.

In accordance with another aspect of the invention, the rigid canopy, when concave, has a radius of curvature in the range of from about 5 to 30 feet or more. Such a radius of curvature will provide for an adequate shelter for the vehicle, while also providing enough of a curve for debris and rain runoff. Alternatively, the canopy can be of any desired shape or curvature.

In accordance with another aspect of the invention, the rigid canopy is composed of a plurality of rigid, self-supporting concave panels attached or secured together in side-by-side complementary relationship. While the canopy material is rigid, it is to be understood that rigid materials inherently will flex to some degree. In one embodiment, each concave panel is suitably secured to another concave panel with, for example, a correspondingly concave or flexible channel member, or other suitable structure. In another embodiment, the transverse edge of each concave panel is secured within a channel member. In another embodiment, the edge of each concave panel is adhered within a channel member.

In accordance with another aspect of the invention, one or more peripheral edging strips are secured to the peripheral edge of the rigid canopy, which rigid canopy may be composed of a plurality of concave panels. In one embodiment, the edging is composed of rigid acrylic material that can be transparent. In another embodiment, the edging is composed of flexible material. The edging provides additional protection of the panels, especially the panel edge, from environmental hazards and shock.

In accordance with another aspect of the invention, the longitudinally extending support member is constructed in a desired configuration and may include two pairs of I-beams, connected together, on a single I-beam or a square beam or pair of square beams with one pair or one beam rigidly attached to the supporting structure and with one pair located on different longitudinal portions of the canopy, which may be different longitudinal half portions of the canopy.

In accordance with another aspect of the invention, the longitudinally extending support member may further include arcuate members laterally spaced along the canopy length that are formed to allow attachment to the canopy at two transversely spaced areas taking into account the canopy's radius of curvature, and have straight vertically extending ends. It is contemplated that the arcuate members are composed of a rigid structural material. In one embodiment, the arcuate members are composed of stainless steel tubing formed to provide the desired configuration such as in an arch shape. The arcuate members are composed of any suitable material including aluminum, steel and composite materials.

In accordance with another aspect of the invention, each arcuate member further includes reinforcing arms that are suitably attached, such as by welding, to inside the tubular arch and also have straight ends. It is contemplated that the reinforcing arms are composed of the same material as that of the arcuate member.

Alternatively, in place of the arcuate members may be utilized angular support members.

In accordance with another aspect of the invention, the longitudinally extending support member further includes flanges that attach the ends of the arcuate members to the rigid, concave canopy. The flanges provide for a secure attachment to the rigid canopy and allow a relatively uniform distribution of forces on the canopy. It is contemplated that the flanges attach to the canopy by any suitable structure, such as, for example, with threaded fasteners, which may be by bolts. It is alternatively contemplated that the flanges attach with a suitable adhesive. The surface of the flange that abuts the canopy may have a curvature to match the canopy in the area of abutment.

In another aspect of the invention, curved or angled flanges are located underneath the canopy in a location directly opposite and complementary to the flanges. This embodiment will allow the concave panels to be rigidly secured and held together.

Alternatively, bolts may be embedded in the canopy material, which can eliminate the need for a bottom flange.

Numerous advantages may be realized by the present invention. For example, the unobstructed view of the sheltered vehicle can provide for a display and draw attention to the sheltered vehicle. This factor will appeal to people who wish to draw attention to their vehicles, possibly because of their rarity or prestige. Alternatively, commercial dealers that display many vehicles, for example, car or boat dealers, will be able to fully put on view and display the vehicles, while simultaneously protecting such vehicles from environmental elements.

In addition to providing for a full view of the protected vehicle, the transparent canopy has the advantage of preserving the view of the surrounding environment in which the shelter is placed. This aspect will especially appeal to people that live in aesthetically pleasing locales that include, for example, mountains, water, trees, flowers, or even other buildings. With this shelter, people will be able to protect their vehicles with only a very minimal obstruction on the view of the corresponding surrounding area.

In accordance with another aspect of the invention, a shelter capable of producing electrical energy is provided. The shelter includes a canopy defining a sheltered area. The canopy may be rigid or flexible and can be of any desired shape or material, including cloth or a membrane material. A photovoltaic device capable of producing an electrical current when exposed to a light source is associated with the canopy to collect sunlight to produce electricity. A supporting structure, which can be constructed without walls, is connected to and supports the canopy and permits substantially unobstructed access to the sheltered area.

The energy generating shelter may further include an electrical load operatively connected to the photovoltaic device for utilizing the electricity generated by the photovoltaic device when the photovoltaic device is exposed to light. The canopy can be mounted for movement to follow the light source such as the sun to maximize electrical energy production.

The photovoltaic device may be any suitable photovoltaic device or material known in the art for converting light energy into electrical current. For example, such devices are typically rigid crystalline photovoltaic systems or flexible thin film amorphous photovoltaic systems and may be composed of numerous photovoltaic cells or modules. The photovoltaic device is associated with the canopy by any suitable arrangement. The photovoltaic device may be supported by the canopy or the photovoltaic device may be applied directly to the canopy surface. Alternatively, the photovoltaic device may be integral to or dispersed within the canopy. The photovoltaic device may even constitute the canopy itself.

In one aspect of the invention a first photovoltaic device may be associated with the top surface of the canopy and oriented to receive sunlight. A second photovoltaic device may be associated with the underside of the canopy and directed to the ground. An electric or other type of light may be affixed to the underside of, or located below, the canopy to illuminate the sheltered area during periods of darkness. The first and/or second photovoltaic device may generate electricity while the light is illuminated.

In another aspect of the invention, the photovoltaic device includes a light emitting diode (LED) or other light emitting device, which can be in the form of a layer. The LED is preferably a thin film, flexible organic light emitting diode (OLED) sandwiched or contained between an upper photovoltaic material and a lower photovoltaic material. Transparent photovoltaic material is preferably used allowing the thin film OLED layer to emit light through the lower photovoltaic material to illuminate the sheltered area at night or other periods of low light or darkness. The light emitting layer may also be a phosphor layer or coating, associated with the photovoltaic device so that the photovoltaic device generates electricity from light produced by the LED or light emitting layer, including at night.

The electrical load that may be connected to the photovoltaic device may be any system or device that may utilize the electricity generated by the photovoltaic device as is commonly known in the art. For instance, the electrical load may include all or part of the power demand of a building or structure adjacent the energy-generating shelter. Alternatively, the electrical load may be the power distribution grid of a nearby utility company whereby the electricity produced by the shelter is distributed to other power consumers located throughout the power grid. The electrical load may also be a battery or other electrical energy storage device as desired. The battery or storage device may be used to power any of the previously described light sources for illuminating any outdoor area, preferably the sheltered area.

In accordance with another aspect of the present invention, a method of producing electricity is provided. The method includes providing a canopy defining a sheltered area and having a photovoltaic device associated with the canopy wherein the photovoltaic device is capable of producing an electrical current when exposed to a light source. The canopy can be supported without walls above an outdoor vehicle parking area with a supporting structure but without walls so that substantially unobstructed access, including ingress and egress of the motor vehicles, to the parking area is permitted. The method further includes exposing the photovoltaic device to light in order to generate electricity and connecting an electrical load to the electricity. The electrical load may include a power meter allowing reverse metering of the power meter with the electricity produced by the shelter.

The energy producing shelter is well-suited for large parking lots and provides the multiple benefits of protecting parked vehicles from sunlight as well as providing an alternate power supply. Thus, a further advantage of the present invention is to reduce the strain on a local power grid by supplying power to adjacent buildings with the electricity generated by the shelter. Alternatively, the shelter-generated power may be sent directly to a utility company or corresponding power grid and distributed to other users within the grid, particularly during peak power demand periods. When used on a large scale, the shelter-generated electricity may assist in preventing rolling brownouts or blackouts in a local power grid.

In an alternative embodiment, the present invention relates to an information display shelter that is preferably photovoltaicly powered having or composed of one or more display panels integrated into the shelter's canopy such that the display panels makes up some or all of the actual roofing system, consisting of separate single display panels or separate sets of display panels devices forming the complete roof canopy, capable of generating electricity from sunlight, artificial light, traditional grid electricity, back up batteries or fuel cell energy storage devices. Additionally, since the carport-roof-displays are solar powered, they can be used to power up any electronic device including, without limitation, an electric vehicle with one or more batteries onboard and showcase huge brightly lit advertisements via the roof mounted display panels synergistically as an all-in-one-solar-powered-carport-roof-display-panel.

DETAILED DESCRIPTION OF THE PREFERRED EMBODIMENT

Figure 1:
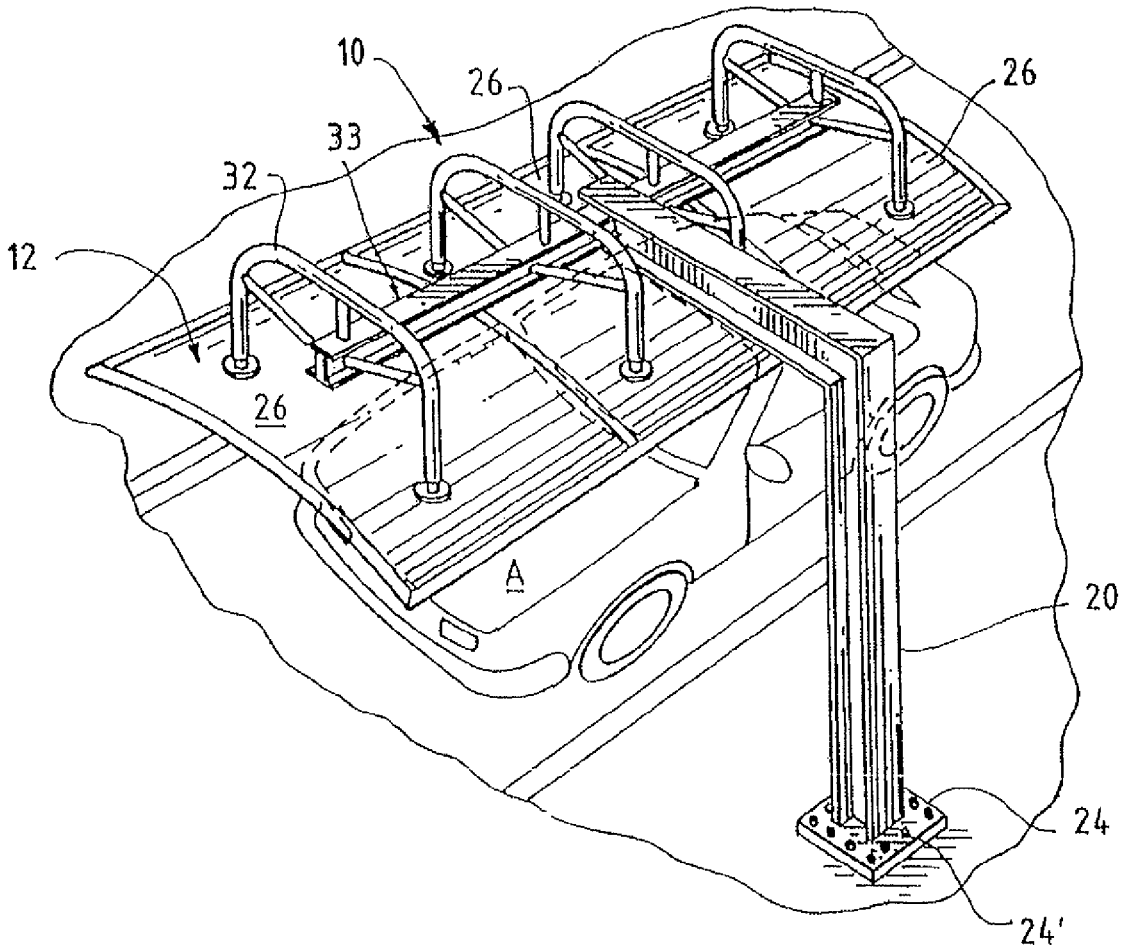
FIG. 1 illustrates a perspective view of a device in accordance with the present invention.

Referring to the Figures generally, there is illustrated a carport 10 in accordance with one aspect of the invention. Carport 10 includes a rigid, self-supporting concave canopy 12 that is composed of a rigid self-supporting material, and that typically is of a width and length larger than the width and length of a standard size automobile A. Carport 10 also includes a supporting structure 14 that rigidly connects to and extends vertically from canopy 12. Carport 10 further includes a horizontally extending longitudinally extending support member 16 that rigidly secures to supporting structure 14 and has an end 18 that is laterally spaced from canopy 12. Member 16 may be an I-beam as illustrated or may be any desired structure such as a tubular or box-like structural member, as long as it is capable of providing the desired structural support.

Figure 3:
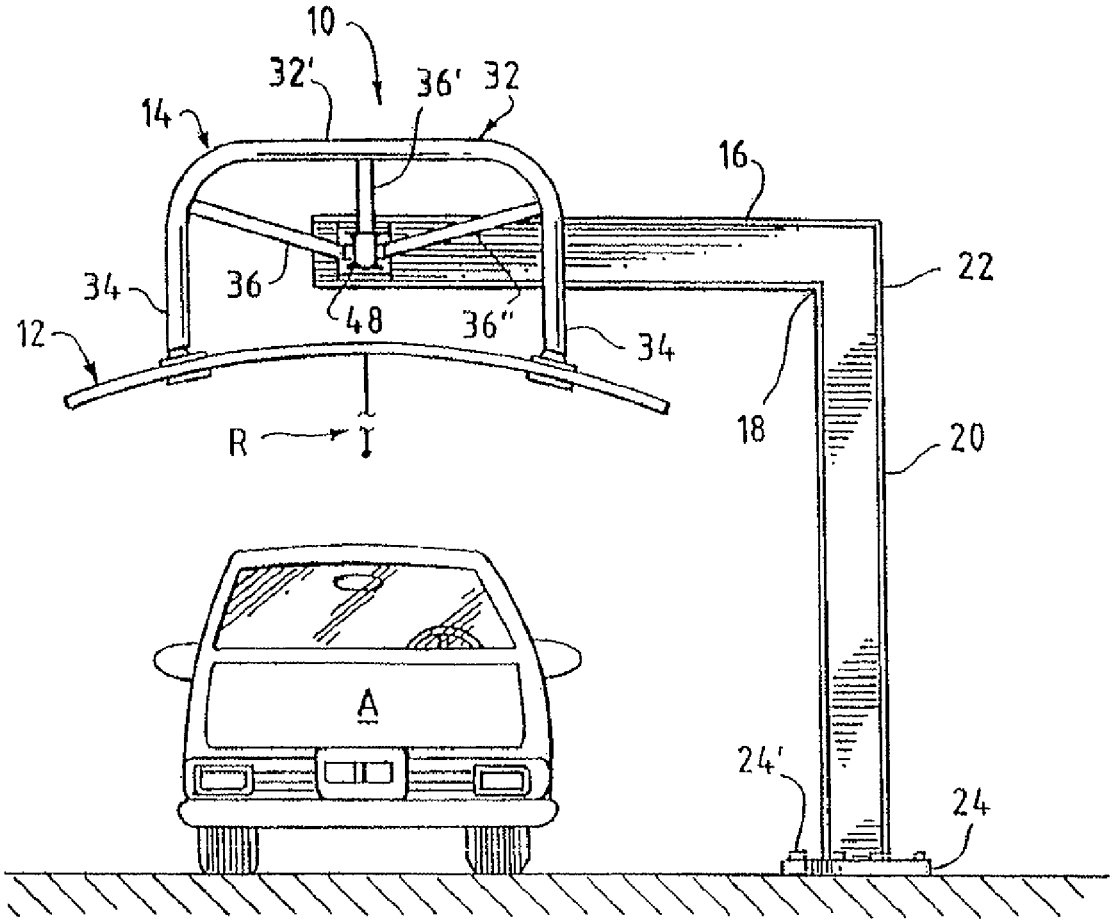
FIG. 3 illustrates a front elevation view of the device of FIG. 1 in an upright position.

Carport 10 further includes a generally vertical post member 20, which in this case is an I-beam, although any suitable structure can be used, that has an upper portion 22 to which laterally spaced end 18 of support member 16 is connected, as illustrated in FIGS. 1 and 3. I-beam vertical post member 20 extends laterally past the edge of canopy 12, as illustrated in FIGS. 1 and 3. Post member 20 is suitable for mounting to a supporting surface, such as a base plate 24, to which it is mounted with bolts 24', as illustrated in FIGS. 1 and 3. Alternatively, post member 20 can be mounted to a foundation (not shown) or other suitable structure. Alternatively, end 18 could be mounted to a building or other suitable structure to provide the desired elevation for canopy 12.

Rigid, concave canopy 12 can be composed of a desired material and may be either light transmissive material or transparent material and optionally can be also composed of light emissive material. Thus, if desired, an unobstructed view of both what is sheltered underneath the canopy and of the corresponding, surrounding environment can be provided, as shown in FIGS. 1 and 3, for example, particularly when the canopy is transparent.

Rigid, concave canopy 12 has a radius of curvature R of from about five to thirty feet, as shown in FIG. 3. Such curvature will provide enough of a slope for debris and rain runoff.

Figure 2:
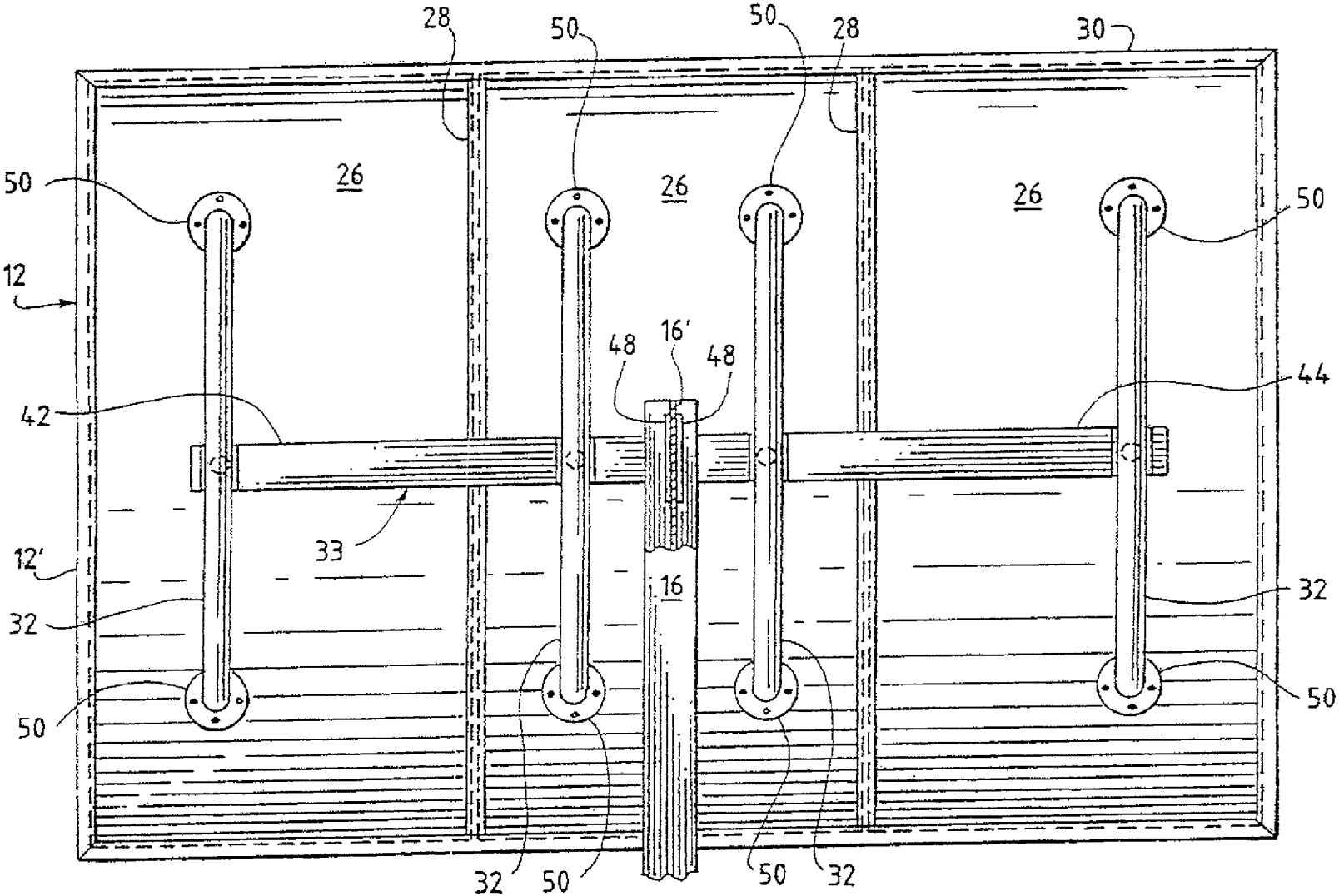
FIG. 2 illustrates a top plan view of the device of FIG. 1.
Figure 6:
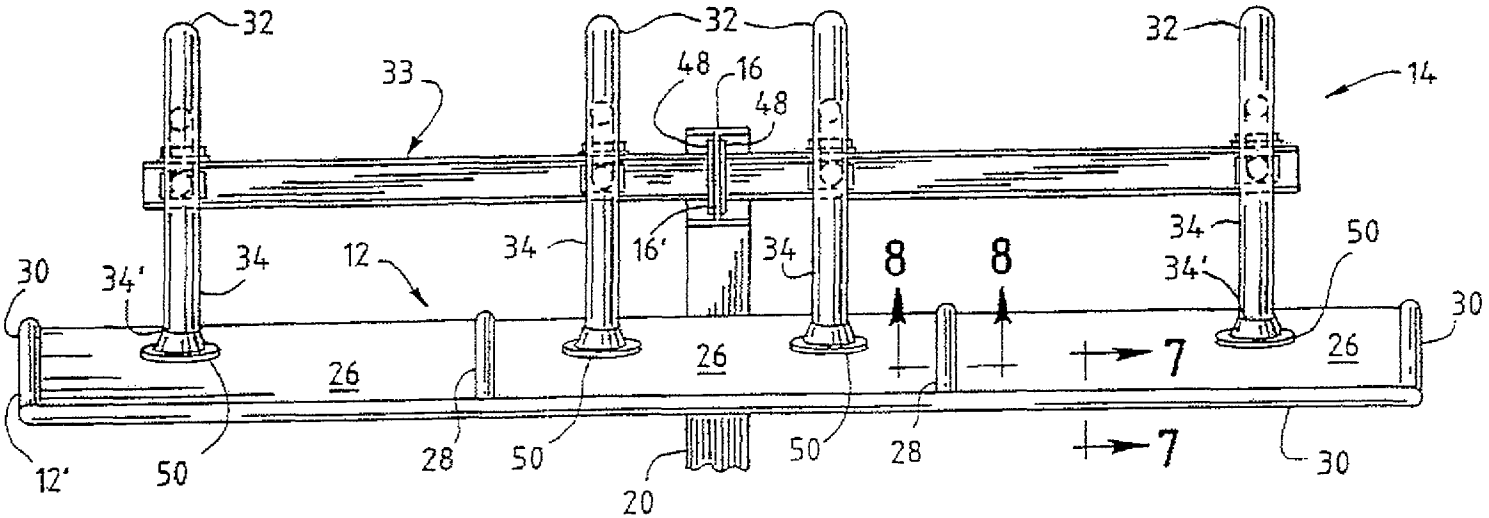
FIG. 6 illustrates a side elevation view of a portion of the device of FIG. 1.
Figure 8:
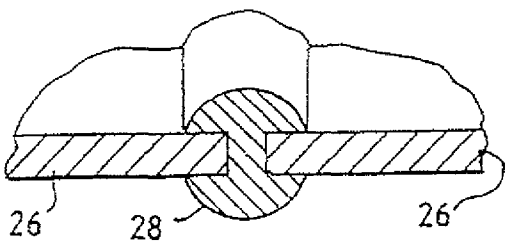
FIG. 8 illustrates a sectional view along line 8-8 of FIG. 6.
Figure 7:
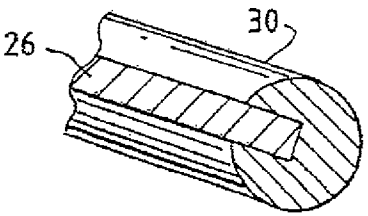
FIG. 7 illustrates a sectional view along line 7-7 of FIG. 6.

Rigid, concave canopy 12 of carport 10 may be composed of a single panel (not shown) or a plurality of rigid, self-supporting concave panels 26 secured in side-by-side relationship, as best shown in FIG. 2. Each concave panel 26 is secured to another concave panel 26 with a concave channel member 28, which is shown in FIGS. 6 and 8. Each concave panel 26 can be bonded into concave channel member 28, which can be accomplished by use of a suitable adhesive, for example, or by a friction fit. Outer concave panels 26 are secured into a concave panel edging strip 30, which is shown in FIGS. 6 and 7. Panel edging 30 protects the edges of panels 26 from the elements and ensures that they remain secured together.

Rigid, concave canopy 12 is suspended from supporting structure 14, as illustrated in FIGS. 1-3. Alternatively, supporting structure 14 could be located below the canopy instead of above (not shown).

Figure 4:
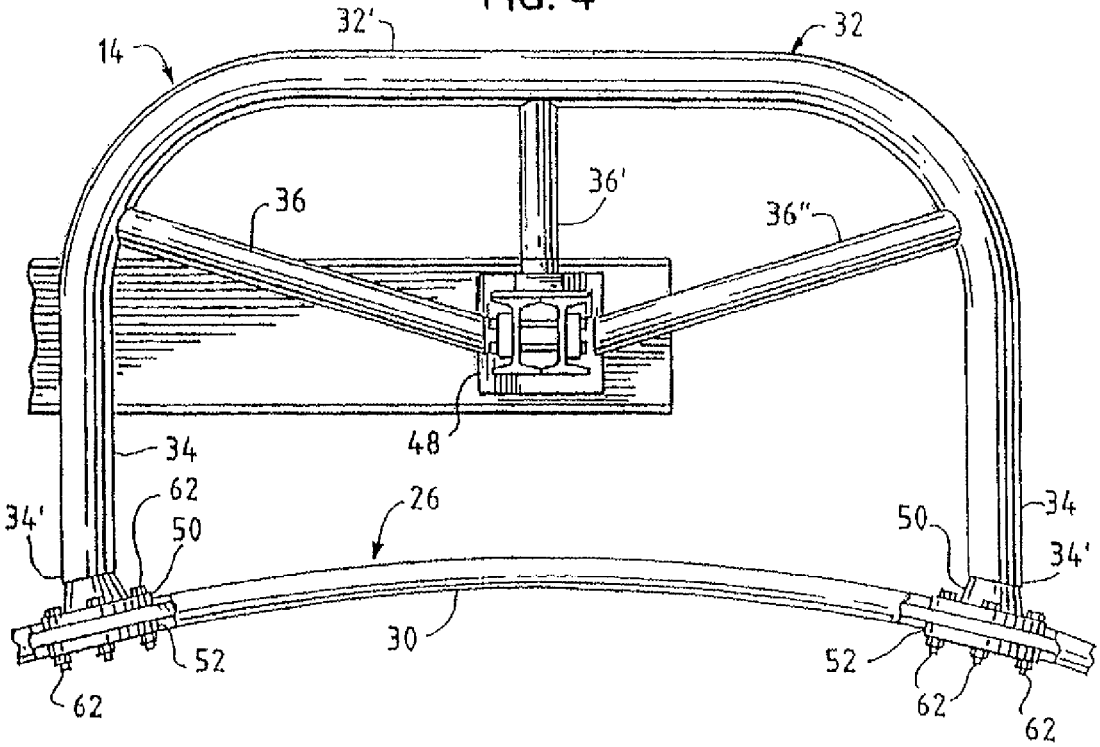
FIG. 4 illustrates an enlarged perspective front elevation view of a portion of the device of FIG. 1.

In the illustrated embodiment, supporting structure 14 is composed of a plurality of longitudinally spaced arcuate members 32 that conform to the canopy's radius of curvature and have vertically extending straight portions 34, as best shown in FIGS. 4 and 6. Arcuate members 32 are composed of a rigid material, such as tubular steel or aluminum, for example, and may be composed of stainless steel tubing that is bent or otherwise formed to provide the desired configuration. Each arcuate member 32 connects to canopy 12 at two transversely spaced apart locations, as illustrated in FIG. 4.

Arcuate members 32 are mounted to a longitudinally extending support member 33 that forms part of support structure 14 by means of reinforcing arms 36, 36' and 36", which together with arcuate members 32, form a rigid structure, as best illustrated in FIG. 4. Arcuate members 32 in one embodiment have a central horizontally extending portion 32', as shown in FIGS. 3 and 4, for example. Arcuate members 32 can be of a shape as desired. Reinforcing arms 36, 36' and 36" provide additional support for arcuate members 32 to ensure structural integrity. Reinforcing arms 36, 36' and 36" include ends 38, 38' and 38" and can be composed of the same material as that of arcuate member 32. Arms 36, 36' and 36"

each have ends 36*a*, 36*a*' and 36*a*" and are rigidly secured to support member 16, such as by welding or otherwise securing a block 56, 56' and 56" to a respective plate 58 or for blocks 56 and 56" to vertical side 42' and 44' of I-beams 42 and 44, respectively, such as with nuts and bolts 60 and 62. Alternatively, any other suitable structure could be utilized to form the desired rigid connection of arms 36, 36' and 36" to longitudinal support member 33. The two downwardly depending spaced apart ends 34' of each arcuate member 32 are secured to correspondingly transversely spaced apart areas of canopy 12 as hereinafter described in greater detail with particular reference to FIG. 4.

Longitudinally extending support member 33 is preferably located above the longitudinal centerline of canopy 12, as shown in FIGS. 1 and 4, for example, and may be in any suitable configuration. In an alternate embodiment (not shown), member 42 of longitudinally extending support member 33 or similar structure could extend longitudinally past one longitudinal end of canopy 12 (such as end 12' in FIGS. 2 and 6) for mounting to a vertical post or other member (not shown) or to a wall (not shown), for example, or other supporting structure.

Figure 5:
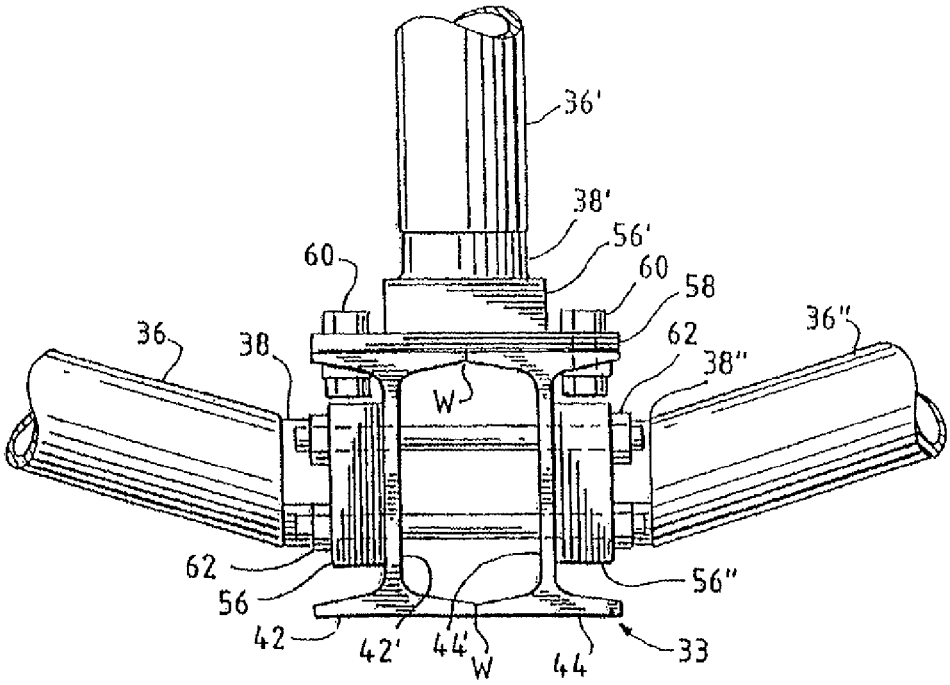
FIG. 5 illustrates a sectional front view of a portion of the longitudinally extending support member of the device of FIG. 1.

In the illustrated embodiment as shown in FIG. 5, longitudinally extending support member 33 is composed of two pairs of I-beams, 42 and 44 respectively, connected together by any suitable structure, such as by welds W, for example, one pair being located on each longitudinal half portion of canopy 12, as shown in FIG. 2. The longitudinally extending support member 33 is securely connected to a transversely extending support member 16, which is illustrated in FIGS. 1 and 2, for example, and as illustrated is an I-beam. End plates 48 are located at the ends of longitudinally extending support member 33 that are secured to the vertical portion 16' of I-beam or member 16 via bolts, as illustrated in FIGS. 4 and 5 or other suitable structure.

Ends 341 of members 32 have flanges 50 that attach ends 34' of arcuate members 32 to rigid, concave canopy 12, as shown in FIGS. 3, 4 and 6. These flanges 50 preferably have a curved contacting surface for contact with the curved surface of panels 26 and thus preferably are curved to the corresponding curvature of the concave panel, as shown in FIG. 3. In addition, each flange 50 has a complementary flange 52 located on the opposite surface of canopy 12 in a location directly corresponding to flange 50 and that is curved to correspond to the curvature of the concave panel, as shown in FIGS. 3 and 4. Each pair of flanges 50 and 52 are secured together with one of panels 26 therebetween by suitable fasteners such as nuts and bolts 62 that extend through the respective panels 26, as shown in FIG. 4. Alternatively, a suitably curved blocking member could be located between the flanges and respective panel 26. To isolate panels 26 from vibration and/or shock from support structure 14, a thin, flexible bushing or pad (not shown) may be interposed between each of flanges 50 and 52 and respective panel 26, which may be constructed of suitable material as desired, such as rubber, vinyl material or polyurethane material, which may be transparent, for example.

Figure 9:
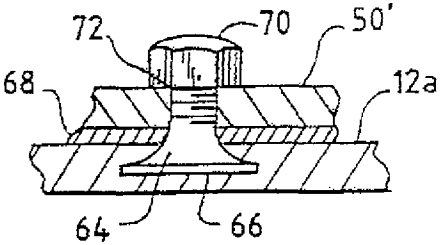
FIG. 9 illustrates a sectional view of an alternate embodiment of an attaching structure useful in accordance with the invention.

An alternate attachment system is illustrated in FIG. 9. A bolt 64 has an end 66 that is embedded in canopy 12*a*, which is similar to canopy 12. End 66 is preferably of relatively large cross-sectional area to distribute forces over a relatively large area of canopy 12*a*.

Flange 50', similar to previously described flange 50 is shown in a fragmentary sectional elevation view. Interposed between flange 50' is a bushing 68 which may be constructed of relatively flexible material such as rubber, vinyl material or polyurethane material, which may be transparent. A nut 70 is threadably fastened onto threaded portion 72 of bolt 64 to secure flange 50' to canopy 12*a*. Any other suitable structure to fasten the supporting structure to the rigid canopy may be used in accordance with the invention.

Figure 10:
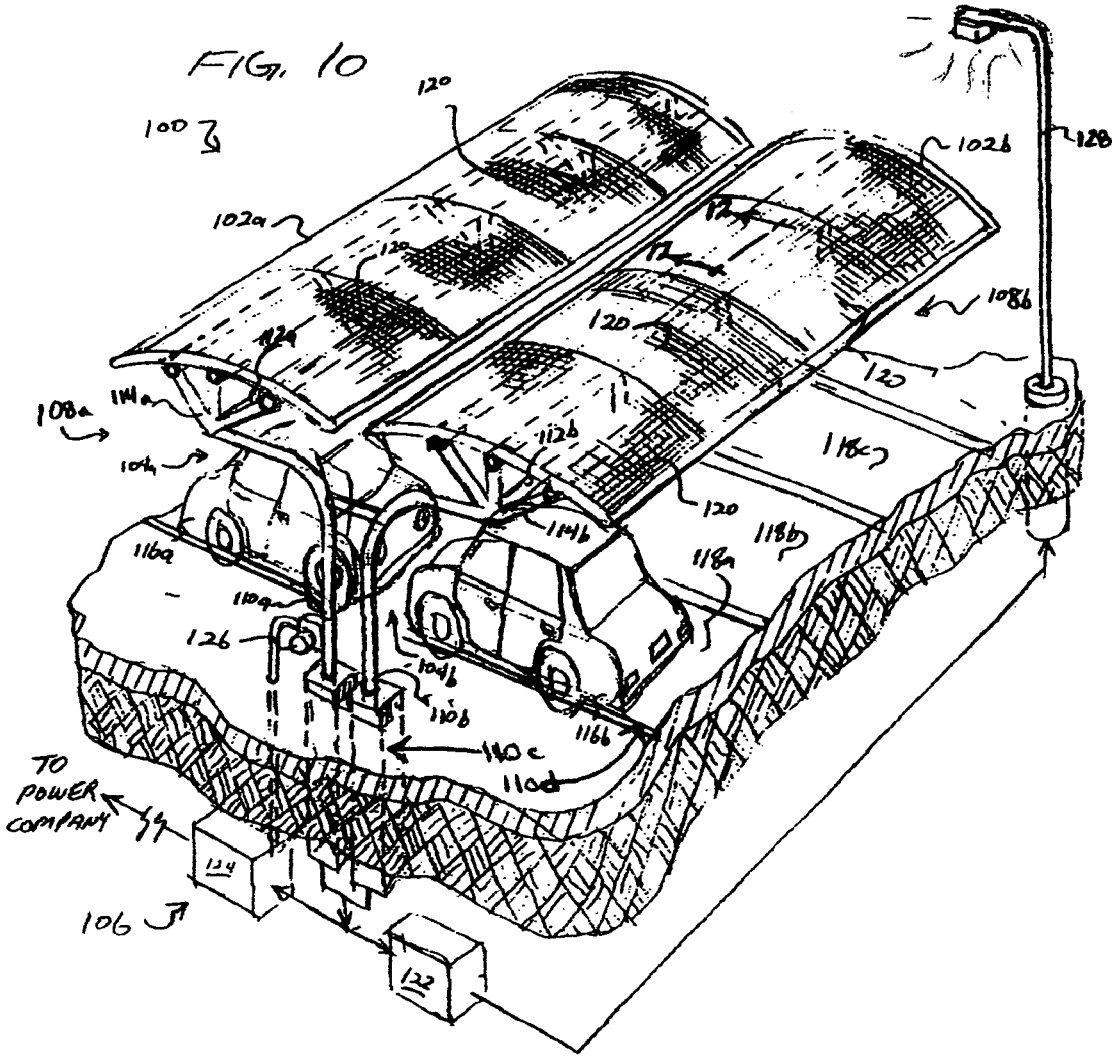
FIG. 10 illustrates a perspective view of an energy-generating shelter in accordance with an alternate embodiment of the present invention.
Figure 11:
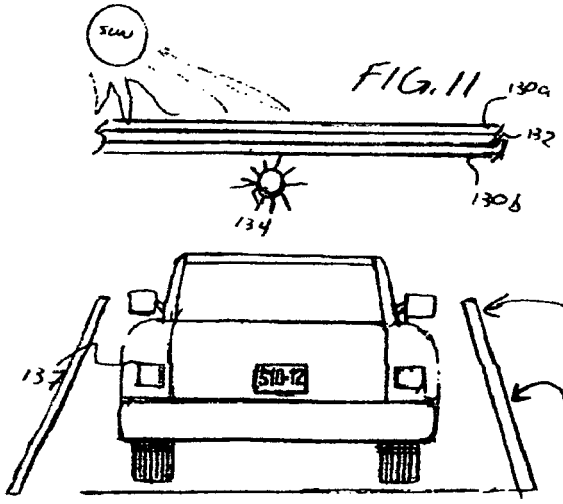
FIG. 11 is a side elevation view of an alternate embodiment of the energy-generating shelter view in accordance with an alternate embodiment of the present invention.
Figure 12:
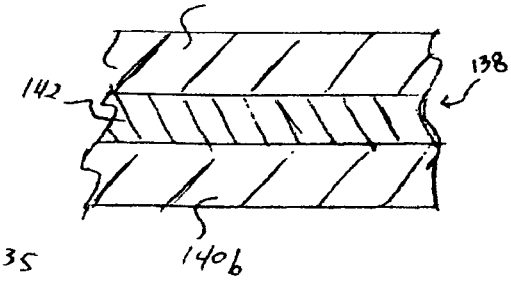
FIG. 12 is a sectional view of an alternate embodiment of the present invention.

FIGS. 10-12 depict alternate embodiments of the present invention. A shelter 100 in accordance with the invention is capable of producing electrical energy. Shelter 100 is wallless and includes one or more canopies 102*a* and 102*b*, supporting structure 104*a* and 104*b*. One of ordinary skill in the art will realize that shelter 100 may include a plurality of canopies and supporting structures (as shown in FIG. 10) or a single canopy and supporting structure without detracting from the present invention. Canopies 102*a* and 102*b* each have a width and a length defining a respective sheltered area 108*a* and 108*b* thereunder. Preferably, the dimensions of canopies 102*a* and 102*b* are such that each sheltered area 100*a* and 100*b* provides sufficient cover for at least one car, a sport utility vehicle, a small truck, or similar vehicle. Canopies 102*a* and 102*b* may be composed of a light transmissive or transparent material as previously described with tinted or untinted glass, plexiglass or similar methacrylate derivatives being preferred and can optionally incorporate or be composed of light emissive material. Canopies 102*a* and 102*b* each may be rigid or flexible, curved, substantially flat, composed of a single panel or composed of a plurality of panels secured in a side-by-side relationship as previously described.

Each supporting structure 104*a* and 104*b* can be of any desired or suitable construction or design and as illustrated includes a respective vertical support member 110*a* and 110*b*, a longitudinal support structure member 112*a* and 112*b* and arch supports 114*a* and 114*b* to support each respective canopy 102*a* and 102*b* above the ground as shown in FIG. 10. Supporting structures 104*a* and 104*b* support respective canopies 102*a* and 102*b* without walls permitting substantially unobstructed access to sheltered areas 108*a* and 108*b*. Consequently, vehicles 116*a* and 116*b* may readily enter and exit respective sheltered areas 108*a* and 108*b* and be substantially sheltered or covered by respective canopies 102*a* and 102*b* while parked in each sheltered area. One skilled in the art will appreciate that shelter 100 may be dimensioned to adequately shelter a plurality of vehicles parked in parking spots 118*a*, 118*b* and 118*c* in a similar manner.

Associated with each canopy 102*a* and 102*b* is a photovoltaic device 120 capable of producing an electrical current when exposed to a light source. Typically, device 120 is a photovoltaic device and any suitable photovoltaic device may be used in the present invention. Photovoltaic devices which generate an electrical current when exposed to a light source are well known in the art. Typically, such devices include a semiconducting component, collectors, grid wires, a contact layer, an encapsulant and optionally a mechanical (i.e., lenses or reflectors) or chemical (i.e., gallium arsenide) concentrator used to increase electrical output and/or an up/down converter (i.e., aluminum arsenide, gallium phosphide, or boron in cubic silicon). Nonlimiting examples of materials known to be photovoltaic are organic or inorganic semiconductors composed of silicon with or without germanium and compound semiconductors such as cadmium sulfide-copper sulfide, gallium arsenide, cuprous oxide, cadmium telluride, cadmium selenide, copper indium diselenide, copper indium gallium diselenide, indium gallium arsenide nitride, lead dioxide, titanium dioxide, dye sensitized solar cells (organic), hybrid solar cells and combinations thereof. The skilled artisan will recognize that photovoltaic device 120 may be configured as a rigid crystalline photovoltaic system or as a thin film flexible amorphous photovoltaic system as is commonly known in the art.

Photovoltaic device 120 may be associated with canopies 102*a* and 102*b* in any suitable manner as is commonly known in the art. For example, the skilled artisan will appreciate that photovoltaic device 120 may be an array of self-contained solar panels affixed to or otherwise supported by either canopy 102*a* or 102*b*. Alternatively, each canopy 102*a* and/or 102*b* may serve as a substrate upon which photovoltaic device 120 may be applied as a flexible thin film photovoltaic system. Photovoltaic device 120 may also be integral to or dispersed within canopy 102*a* and/or 102*b* and can be of any suitable type, for example, either a crystalline structure or an amorphous thin film system. When adequately encapsulated, photovoltaic device 120 may even be utilized to form the canopy itself. It is understood that canopy 102*a* and/or 102*b* as well as photovoltaic device 120 may be continuous or non-continuous as it may be necessary to intersperse supporting devices between adjacent canopy panels and/or photovoltaic device panels. Regardless of the association between photovoltaic device 120 and canopies 102*a* and 102*b*, it is preferred that photovoltaic device 120 is suitably oriented to receive sunlight.

It is apparent that the most effective photovoltaic energy generation will occur when shelter 100 is situated in high and direct sunlight exposure areas, direct sunlight being most preferred. To maximize sunlight exposure, longitudinal support members 112*a* and 112*b* and arch support members 114*a* and 114*b* are preferably disposed on the underside of each respective canopy 102*a* and 102*b*. It is contemplated that application of shelter 100 to the open sun-exposed areas of large parking lots presents particular synergistic benefits of the present invention as will be described hereafter. Shelter 100 may be used at individual residential or commercial parking areas as well. Photovoltaic device 120 could be mounted to any suitable structure or mechanism for movement in order to follow and be oriented towards the sun for maximum efficiency.

Wiring (not shown) extends from photovoltaic device 120 through supporting structures 104*a* and 104*b* to deliver the electricity generated by photovoltaic device 120 to electrical load 106. Electrical load 106 may be any device or system that transports, uses, or stores electricity as is commonly known in the art. In one embodiment of the invention, electrical load 106 may be the electrical power demand of a building or dwelling adjacent shelter 100. In this embodiment, the electricity generated by shelter 100 is sent to a power converter or inverter 124 to convert the DC electricity generated by photovoltaic device 120 into AC electricity. The AC electricity is then sent to the building to supplement, reduce or substitute altogether the power supplied by a conventional utility company.

Alternatively, electrical load 106 may be a local power company which utilizes the electricity generated by shelter 100. The AC electricity of power converter 124 may be sent directly to a local utility company to be distributed to other power consumers serviced by the utility company. The shelter-generated power may also be divided among multiple loads. For example, the AC converted electricity generated by shelter 100 may be used to supply power to an adjacent building with any excess electricity delivered to the nearby utility company.

In the event it is not possible to send electricity to the utility company, provision of a power meter 126 operatively connected to either shelter 100 or an adjacent building powered by shelter 100 enables the electricity generated by shelter 100 to reverse meter the power meter 126. Reverse metering occurs when excess electricity produced by shelter 100 spins power meter 126 backwards effectively banking the electricity until it is needed. This enables the operator of shelter 100 to obtain full retail value of any shelter-generated electricity.

In an alternate embodiment of the invention, electrical load 106 may be a battery 122 to store the shelter-generated electricity for later use. Battery 122 may be electrically connected to a light 128 as shown in FIG. 10. Light 128 may be used to illuminate sheltered area 108*a* and/or 108*b* or any outdoor area such as a parking lot, for example, during nightfall or other periods of little or no sunlight. It will be appreciated that photovoltaic device 120 may generate electricity when exposed to light emitted from light 128 or other artificial light.

FIG. 11 shows another embodiment of the present invention wherein a photovoltaic device 130*a* is associated with the upper surface of a canopy 132 and a photovoltaic device 130*b* is associated with the underside surface of canopy 132 in any suitable manner as previously described. Photovoltaic device 130*a* is oriented toward the sun while photovoltaic device 130*b* is directed toward the ground. Photovoltaic devices 130*a* and 130*b* may be composed of transparent flexible film photovoltaic material as is commonly known in the art enabling photovoltaic devices 130*a* and 130*b* to be composed of multiple layers of photovoltaic material.

An electric light 134 of any desired type is attached to the underside of, in between the layers or located below, canopy 132 and may be operatively connected to battery 122. Light 134 may be any suitable light emitting device including, but not limited to incandescent, fluorescent, metal ion, or halogen based light sources as well as an organic or inorganic light emitting diode. Light 134 may be a conventional bulb configuration or a thin film system as is commonly known in the art. Shelter-generated electricity stored in battery 122 may then be used to power light 134 and illuminate sheltered area 135 and vehicle 137 during periods of darkness. The presence of photovoltaic device 130*b* on the underside as well as on the top side of canopy 132 allows for the generation of electricity when light 134 is illuminated. It is understood that light 134 may include a switch enabling an operator to select either battery 122 or conventional power as the light power source.

FIG. 12 depicts a further embodiment of the present invention wherein a photovoltaic device 138 is composed of a layer of photovoltaic material 140*a* oriented to receive sunlight, a thin layer light emitting material, which can be light emitting diode (LED) 142 or other light emitting or emissive material, including a phosphor layer or coating, for example. Light generated by the LED or light emissive material can be used to generate electricity by photovoltaic device 138. Stacked layers of photovoltaic devices and light emissive materials can also be used, if desired, and a photovoltaic material 140*b* oriented toward the ground. Photovoltaic material 140*a* and 140*b* may be the same or different. Preferably, both photovoltaic material 140*a* and 140*b* are composed of a single layer or multiple layers of flexible thin film transparent photovoltaic material as is commonly known in the art. Photovoltaic device 138 may be associated with canopy 102*a* and/or 102*b* in any suitable manner as previously described. Preferably, photovoltaic device 138 is dispersed within or encapsulated by either canopy 102*a* or 102*b*.

LED 142 is preferably an organic light-emitting device (OLED). OLEDs are thin, film-based organic substrate layers sandwiched between a transparent anode and a metal cathode to produce surface emitting light. OLEDs are readily deposited on flexible plastic films or foils making them well-suited for use with flexible thin film photovoltaic systems. OLEDs are typically deposited or fabricated on a glass or plastic substrate to form a multi-layer structure having a thickness typically in the range of about one hundred to about several hundred nanometers. The photovoltaic material and OLED can be located on the same substrate and can be vapor deposited or formed in a roll-to-roll system by any suitable method known in the art.

Preferably, photovoltaic device 140*b* is transparent, enabling LED 142 to illuminate the sheltered area when operatively connected and powered by battery 122 during periods of darkness. A layer of reflective material co-extensive with LED 142 may be placed on the upper side of LED 142 to direct the light emitted from LED 142 substantially downward. One of ordinary skill in the art will recognize that photovoltaic device 140*b* may generate electricity when LED 142 is illuminated. LED 142 may be operatively connected to a switch allowing an operator to select whether LED 142 is powered by battery 122 or conventional electrical power. LED 142, dispersed or placed in the roofs vicinity, can be used to display human readable indicia, and thus can be used as an information display while generating electricity simultaneously. Such LED displays and associated equipment to display indicia are well known in the art and are not described in detail herein.

Figure 13:
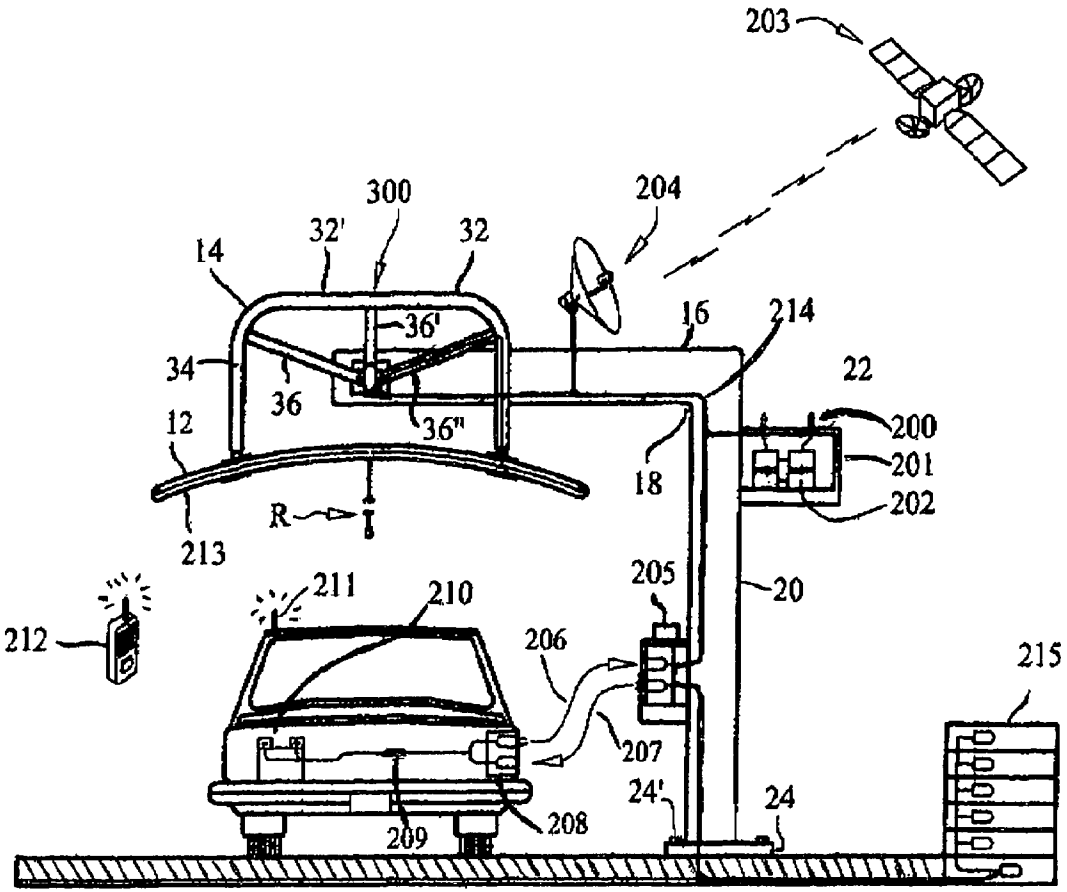
FIG. 13 illustrates a front elevation view of a shelter in an upright position in accordance another alternate embodiment of the present invention.

In accordance with a further embodiment of the present invention, an information display shelter 300 such as that depicted in FIG. 13 is capable of showcasing interactive images text or video from the enclosed roof mounted display panel 213. The carport roof display panels 213 preferably include light emitting displays and solar panels or solar cells attached to the front or backside of the display panels and are capable of generating solar electricity when exposed to outdoor sunlight or internal artificial light emanating from any of the attached LED, OLED, or electro-luminescent display panels. The internal light generated or emanating from any of the display panel light sources associated and attached to the carport roof panels will be attached to the carport roof panel to form the display roofing platform. The display panels 213 which make up the roof panels can be light emissive information back lighting display panels or conventional video capable display panel layers, such as are used in light emissive plasma televisions or LED/LCD televisions, OLED, or LED display panels that are connected, attached or embedded into carports solar panels in which the roof panel can double as an information display and produce electricity simultaneously.

By using emissive display panels to showcase information or video via the carport-roof-display-panels 213, the displays will simultaneously reduce or even create internally their own electricity from the artificial light that emanates from the emissive display panels or other backing lighting emissive lights, used with the solar mounted roof panels which will synergistically reduce the carport display's energy consumption with the embedded solar cells or solar panels attached to the carport-displays. Alternatively, any backlit advertisement display panel or flat or curved advertisement kiosk case can be mounted to the carport's trusses or supporting structure to act as, or make up, the carport roof system and still shelter people from the elements and synergistically showcase displayed advertisement with paper, vinyl, or video projected images shown onto the roof panel without the use of the solar panels or the light emissive displays.

The carport roof panels, which are preferably made up of the information display panels 213, can be self-powered from the solar panels attached directly to the carport roof display-panels and showcase beautiful advertisements, providing a synergistic advertising platform that acts as the carport's roof system and a protective shelter system at the same time. Likewise, any traditional electrical energy stemming from the electric grid can also be supplemented and power the attached electronic backlit lighting for the displays or the internally powered emissive carport roof display panels 213. Traditional AC electrical energy from the grid would be needed to power up the displays only if the backup energy systems were not running. A battery, fuel cell, electric generator or even a car parked underneath the information display shelter's canopy 12 can act as the backup energy system to power the displays or transfer any of their energy through the carport's bi-directional inverter charger system 205 that is attached to the carport's vertical column support 20 and power-up the roof mounted information displays, servers 215, database systems and telecommunications equipment, at any given time.

The information display panels incorporated or making up to the canopy 12 can showcase: text, picture images, video, e-mail, instant messages, text messages or any other type of human readable indicia such as logos or trademarks or even beautifully lit advertisements. Any type of information exchange or communications can occur and be exchanged between the carport roof panel displays 213 and any cell phones 212, satellite phones, personal digital assistants (PDAs), laptops or a even automobile's wireless dash mounted GPS display system, and can send and receive telecommunications messages between the carport displays and these handheld wireless devices 212 via the carport display's telecommunication equipment. Most handheld mobile communication devices have certain wireless frequencies and transceivers they rely on giving each handset the ability to translate and process voice, video or data, information using different radio signals and in an electronically condensed handheld device and format.

The shelter's display panels 213 have the same capabilities and functions of the displays on most mobile handsets enabling them to showcase images, video, text, as well as optionally sending and receiving radio signals. The enclosed shelter with its attached transceivers 202 and telecommunication electronic equipment is mounted in the information shelter's junction box 201 and will power and drive the appropriately-sized, roof mounted information display panels 213 which are attached to the shelters supporting structure. The carport roof panels can be made into one huge display screen or made up of many smaller display screens connected together to form one carport roof display screen, and showcase and exchange: information, data, images, pictures, and even video between handheld wireless devices 212 or any other device capable of exchanging electronic information data via wireline or wireless (e.g., radio) communication mediums, such as telephone lines, power lines, cable transceivers, satellite antennas and transceivers 204, cellular transceivers, WiFi transceivers, WiMax transceivers, Bluetooth transceivers or other electronic equipment built into the particular handheld device.

This wireless exchange of information or video aspect of the carport roof/displays can be programmed and sent or retrieved from the carport's attached servers 215 and central database that runs the carport display panels 213. Also, the wireless satellite dish 204 or other antennas attached to the carport display can function as a gateway between the carport's database that is centrally located nearby or sent via the Internet by a single computer terminal or various computer terminals that are wired or wirelessly transmitted through the carport's satellite dish, wireless antenna's coaxial or fiber optic cabled system 214. The carport roof mounted display screens can also be pre-programmed to run from a downloadable hard disk, USB, DVD/CR-ROM, floppy disk, flash card, SIM card, RFID tag/card or any other storage medium that has been created that can run any information to the carport roof display screens and showcase information, data, video or any type of indicia, including advertisements.

The carport displays can also be self-programmed to run by themselves through a database terminal that can loop or repeat the advertisements to all of the other carport displays that are connected by hard wired cable or wirelessly linked to the carport display's telecommunications equipment and servers 215. The information display shelter's transceivers, controllers, video drivers and processors can be separately housed in an electronic junction box 201 mounted to the carport's vertical column 20 which can be cooled and ventilated to run and house all the electronic equipment, which segregates all the visual displays attached to the shelter's structure from these heated components, in order to smoothly operate the carport's display panels 213 more efficiently. Alternatively, each TV/Display screen can have all the electronics and telecommunications equipment housed in the display case of the roof panel which does not overheat such as plasma and LED or LCD televisions.

The images formed on the carport display screens can be one huge screen with a single image, or can be separate images, video and data on each separate screen showing picture-on-picture images or form literally 20-50 separate images or advertisements on the same display screens depending on the number of TV/displays selected to make up the information display panels 213. The displays that make up the display panels 213 can be assembled and constructed of many types of, television display panels, LED panels, LCD-LED panels, plasma displays, DLP backlit panels, fiber optic panels, OLED panels, silicone emissive panels, electrophoretic panels, electro-luminescent panels, dye sensitized emissive panels, electro-chromic panels, Neon light panels, cathode ray tube panels, glow-in-the-dark panels, florescent, incandescent, or any other light or any combinations of image forming or back-lit panels, that light-up or form an image to very brightly showcase carport-roof-display-panels images during the daytime.

In this setup, the televisions or displays forming the canopy 12 when placed next to each other, or stacked back-to-back, would independently form one huge display screen capable of showing single sided or dual sided images or video and synergistically provide a roofing shelter system, depending on size of the display screens which can be assembled and installed easily to form one huge roof panel capable rolling up, folding-up or be unattached in case of a storm. The display screens 213 can showcase images, video, text, data information and ultimately beautiful easy to see advertisements for a streamlined elegant carport roof display system. Alternatively, the carport roof display panels 213 can be composed of independent televisions or laptop type displays screens attached to the unobstructive, cantilevered carport superstructure that holds up the carport-display-roof-panels, which may be backlit with special super bright LED lighting.

The design of the carport roof display screens would be placed in an enclosed metal cabinet frame or plastic flame casing that would hold and house each display screen consisting of separate carport roof display panels 213 which also can double as a large single screen, multiple screens or dual-sided screens, divided in blocks in the same or a separate framing cabinet or cabinets to form the roof panel displays.

The displays, when attached inside a metal or plastic frame, can be placed side-by-side to form rows and columns of TV displays, which could eventually form one huge display screen, being curved, flat, multi-radius or whatever shape and dimension or thickness the roof is desired to be as long as the TV/displays were placed next to each other. Such an arrangement would provide the impression that each individual TV/display in each row or column of the framed housing has no borders, further giving the impression of one large single display screen made up of many screens for outdoor use and assembled in the frame to act as the roofing system for the information display shelter 300.

This synergism and unique aspect of a carport roof display system acting as a display screen and a shelter is quite unique and novel in that anyone passing or parking under the shelter's canopy 12 would see very brightly lit advertisements, video, text, images, or pictures with appealing low, medium or high resolution advertisements which can be protected from the outdoor elements when acting as the roof system and encased. The outdoor carport roof display screens will be designed for use in rugged outdoor weather conditions and encased in steel or hard plastic frame and casing.

The canopy displays will be very streamlined, elegant, and have a very low profile cabinet mounting frame, with or without attached solar cells, display screens and electronics. Each separate display panel in the framed cabinet is capable of tilting in the framing cabinet for better visibility from a distance and may be electrically controlled by actuators. Alternatively, the whole roof display system can tilt as a whole unit, instead of each separate display panel or screen tilting within the framing cabinet. Yet another alternative way that the carport roof display screen can tilt is by the moving the cantilever superstructure trusses or support arms that hold up the canopy 12, whereby the carport structure can rotate and, in turn, tilt and move the canopy roof panels 213 by using hydraulics, pneumatics or electro-mechanical motors or servos and actuators.

One outdoor feature of the information display screens 213 would be that, when patrons walk by or park under the canopy display screens in big box or outdoor mall and commercial retail parking lots and see the huge brightly lit images or video advertisements that emanate from the carport's roof mounted display screens, the people and their portable wireless phones can actually interact with and through the shelter's communication equipment (e.g., antenna 200, transceiver 202, and server 215) and display screens. People with wireless handheld phones 212 would be able to interact with the carport's roof mounted wireless displays and even be able to connect through the carports' wireless telecommunications transceiver equipment if their wireless phones were equipped with WiMax, WiFi, cellular, Bluetooth or even satellite communication transceivers.

The displays attached to the carport-display screens would facilitate all the electronic telecommunication/transceiver equipment: for two-way or one-way communications where the electronic equipment is placed on top of the carport's top decking, embedded in the carport roof display panels themselves, or housed and placed in an attached electrical junction box 201 but still electronically connected yet isolated to the carport's column junction box 205, which may include one or more inlets 206 for supplying electrical energy to the display panels 213 when solar power is not used and one or more outlets 207 for facilitating charging of devices plugged into the outlet(s) 207, such as an electric car's battery bank 210, using energy produced by the solar panels. Separately and alternatively, the carport display screens can have some or all of the electronic transceivers, drivers, and controllers embedded into the roof mounted display screens instead of housed in the attached junction box 201 or any combinations can be possible depending on outdoor seasons or location.

The carport roof mounted displays which now form the carport canopy 12 or roof system can be powered by the attached solar panels placed atop, in-between, or even below the attached roof mounted displays screens to power up the displays. The solar panels attached to the roof mounted displays making up the roof system would face the sun and receive their energy directly. Alternatively, the solar panels can be integrated and embedded as a single unit into the display panels acting as the carport roof display back panel, so the outdoor sunlight can shine on the back side of the roof mounted display panels and power up the display screens directly. Alternatively, the solar panels and display screens can be embedded, screen printed, vapor deposited or roll-to-roll printed into the glass, rigid plastic or flexible membrane or plastic materials to form the carport's solar powered roof system. This way the shelter 300 can become an energy generating carport roof display system and can showcase images, text, video or advertisements, all while protecting people and their vehicles from the elements. The shelter 300 includes a combination of high tech display technology and light emissive, image forming, coating technology using OLED and inorganic LED thin film, organic or silicone thin film, and nano-technology solar cells for the display and solar cell devices which currently exist.

An alternative design for the carport's roofing-display platform system could include a rigid roof casing, a metal tubular light weight chrome alloy space frame, or box or bird cage framed cabinet, where the solar panels could mount atop the roofing framed platform made of steel, glass, wood, plastic or even carbon fiber. The ideal configuration or housing for the carport roofing frame is to house the electronic displays next to each other with a tiny gap preferably about one (1) millimeter apart and use a rubber dampener to absorb the shock between the displays screens. Another useful configuration for the carport frame would be to create a metal cabinet with internal metal grid like framing and encase the rigid frame-grid with a outside skin made of plastic or preferably light gauge steel to encase and seal the display panels from the outdoor elements and give the carport roof display a body or skin so to speak.

Between the metal flaming slots where the TV displays or display panels rest, space should be left for the straight and flat TV screens edges to rest on each grid or slot in the metal frame, especially if the roof system is to include a curved look or multi-radius bends. In such a case, the bend of the grid or carport roofing frame can be made in sections and welded or bent to conform to the TV's or display panel's length and width outside dimensions. After the space frame has been created and the slots or grids are measured to place the TV screens in, a gap of at least one (1) millimeter should remain to put rubber compound-bushing strips in-between the TV and the inner space frame steel slots, which should be countersunk. The TVs or display panels should fit snug and flush in the frame. After these steps are done, an outside skin or body can be created to enclose the display frame in any material, such as plastic or polished, brushed thin gauge metal, to house the whole framed TV display roofing system and to insure that no snow, water or condensation gets in the device.

Alternatively, the carport display screens can be recessed in the same metal-framed, tubular chassis platform to protect the outside edges of the TV display from being chipped where each TV is sunk into the metal framing for a better and snug fit. In this and the previously—described arrangement, the roof-display platform has strong metal to support the weight of the TV or display panel using flush mounted and welded flanges to attached the space frame to the carport's superstructure for ease of bolting on and unbolting the roof display.

The structural edges of the space frame and outside skin, if used, should have smooth bull-nose curves for a nice streamlined aesthetic look. Alternatively the TV/displays can be bolted in the space frame for case of removal from under the carport roof and lock in each TV as a separate individual component that is non-permanent for ease of fabrication assembly and disassembly. This would allow the solar panels and displays attached to the space carport roof display space frame to be easily unattached in case of damage to the solar panel placed above the carport roof frame system and then replaced. The lower mounted displays screens could also be dismounted and unassembled from the main roofing space frame platform and exchanged quite easily, eliminating the need for an all-in-one-device which has a higher probability of external damage after time, than if designed and made in isolated components or layers for ease of maintenance.

The additional function of directly self-powering the integrated displays with solar cells or solar panels reduces the need for grid-facilitated traditional electrical energy consumption all the time and, helps reduce $CO_2$ carbon emissions that cause global warming. The solar roof mounted and powered displays could run on either DC power directly from the solar panels, batteries or any back-up systems that are DC powered and facilitated via the carport's inverter charger system 205. If the solar panels are used to power the displays and they require AC energy, then an attached bi-directional-inverter-charger can be used to convert any solar power from the solar panels from DC to AC power, to facilitate the conversion of energy for the carport display panels to power up. The carport displays can also be powered by AC grid electricity power and use any type of fuel cell, or battery backup system and ran through the attached inverter-charger to change DC current to AC current and power-up the single or dual mode carport roof displays.

The carport display roof with solar panels can provide additional solar power created through the inverter-charger system that is connected to the carport's column and power any electronic device. Additionally, the roof mounted solar panels connected and attached to the roof mounted information displays and space frame would be able to send its own solar power to the inverter where the solar generated DC current would be converted to AC current to recharge any local electric vehicle's battery bank 210 through an associated power transfer cable 209 and bi-directional inverter-charger 208 attached to or on-board the electric vehicle, or transfer solar energy to a hydrogen fuel cell to power up the device. Once the fuel cell device has had time to process its water into hydrogen, the useable hydrogen liquid would then power the fuel cell to support the carport's electronic displays either with direct current or alternating current. The carport would then use that same fuel cell to power up the carport's display panels through the attached inverter-charger system.

Additionally, the carport roof display system can be made up of advertising display panels and can use any type of advertisement display platform, such as a flat, curved or multi-radius kiosk, billboard system platform, paper, vinyl or even membrane material mounting system to form the carports roofing-display system and simultaneously shade and protect a vehicle from the elements and does not need to use any solar energy or electronic equipment or light emissive material. The unique synergism of a curved, flat, or angled or multi-radius outdoor display panels made up of TV's or display panels that also acts like a shelter system (e.g., that showcases advertisements and acts or doubles as a roofing system) is still very novel and unique to this carport display shelter system by placing showcasing advertisement directly under the roof panels and then tilting them for better viewer visibility.

Another unique feature of this carport display, acting as an information display and a roofing system simultaneously, can be used to shelter a person from the scorching heat and receiving shade from the carport roofing displays while the carport transports wireless free coupons, sales discounts, to the persons cell-phone in electronic from via short message service (SMS) text message, multimedia messaging service (MMS) video message, or instant message (IM). These coupons sent electronically (e.g., i-casted) from the carports transceivers can also be sent with WiFi, Bluetooth, WiMax and or the carport's satellite system, to any Satellite phone (e.g., via a satellite 203), dash mounted GPS/LCD display system (e.g., through the car's roof-mounted antenna 211), cell phone with WiFi or Bluetooth, or even sent to a person's onboard car radio system while the person is still sitting their vehicle out from the sun and shaded under the canopy 12, in the retailers parking lot.

The i-casting of an advertisement sent via the carport's telecommunication and transceiver equipment or sent via the carport's wireless internal transceivers housed in the carport roof wireless displays can be for consumer informational purposes while a person is still sitting in their car shaded in the grocery store parking lot. The advertised announcement or awareness of coupons can also be mounted to the carport roof displays to make consumers parking under the carport displays more aware that such a coupon system exits, in which the ad can be sponsored by an advertiser. As the consumer is made aware of the carport mounted and displayed advertisement, he or she is asked to voluntarily log in their personal information to the retailer store's website or the carport display's corporate website to simultaneously be sent wireless i-casted coupons via the carport telecommunication equipment while the consumer is sitting in the parking lot in the comfort of their car.

As the consumer enters the parking lot and is parking, or leaving the parking lot, the consumer is made aware that if they choose to opt-in to the carport display's i-casted coupon advertisements, they will receive a discount or a coupon on any purchase. The consumer is encouraged to look at as many coupons as they like or shop around so to speak. The more coupon-based advertisements they choose to look at, the more discounts the consumer will receive. In this scenario, the consumer is choosing to opt-in to the carports wireless i-casted coupon based advertisement system, which can be internet, WiFi and Bluetooth enabled and communicated to a person's PDA, cell phone, I-pod, satellite phone, GPS dash mounted display or the car's owners radio system by e-email, text message or directly sent to the person's screen saver on the phone to which the coupon, text, or web hyper-link image is transferred. The carport display roof panel will send an inquiry to each consumer, even as they are leaving the parking lot, if the consumer would like to voluntarily opt-in to the coupon based i-casted advertisements of a local restaurant or food chain diner down the street and offer potential savings, coupons, discounts or "buy one get one free" dinner specials.

The incentive i-casted based advertisements that are showcased and sent via the carport's telecommunications transceivers are also displayed on the carport roofing system and serve to help inform local consumers in the parking lot that sponsored advertisements can be beneficial and in good taste to the consumers, the retailer and the advertiser when the consumer gets something in return for looking at an advertisement based coupon sent directly to their cell phone directly before, during or after they exit the shopping center, mall and box retailer parking lot. The more the consumer looks at the advertisements, the more savings they will accumulate.

All these wireless coupon i-casted wireless transactions will be monitored via the carport's server's database and tabulated and complied at the end of the day for each retailer and advertiser to see how many people have actually responded to the i-casted ad or were receptive to the advertisements sent out in electronic format and looked at by people. This information can then in turn be used to guide future ad campaigns of the advertisers and retailers and determine how much each advertiser pays in such a service with and facilitated by the carport display owner in return for the information for which advertisers are willing to pay.

Additionally, the information display shelter 300 is capable of protecting people and vehicles from the elements while also being able to interact with a person's cell phone or other handheld wireless devices. The roof mounted displays which act as the carport roof system will showcase and send: advertisements, text messages, instant messages, photos, video, or any other textual, graphic and/or video information, and can be used to interact with a person's cell phone through LED infra red lasers, body gestures, voice commands or through a graphical user interface/voice user interface (GUI-VUI) on a person's cell phone and act as a two way information gateway or information portal to send and receive wireless information, data, video, images, photos, or gaming graphics through the carport's telecommunication transceivers and roof mounted display equipment.

Further, the information display shelter 300 can protect an individual from the elements as they recharge their electric cars battery banks 210 or facilitate their hydrogen fuel cell car to produce hydrogen via the carport's solar paneled roof and attached inverter charger system while each car and consumer parked underneath the shelter's canopy can interact with and through the attached carport roof display panels 213, which can also monitor and display the electric car's charging rate and facilitate all free incoming and outgoing cell phone or satellite phone calls, text message advertisements, WiFi, WiMax or Bluetooth enabled devices that send and receive messages in the vicinity, through the carport-display antenna system free of charge through the carport-display canopy, database, servers and telecommunication-transceiver mounted equipment.

In yet another embodiment, the information display shelter 300 includes a canopy 12, a supporting structure, a receiving device 202, and a signaling path 214. The canopy includes a display area (e.g., one or more display panels 213) on at least one surface thereof. The supporting structure is connected to and supports the canopy over a sheltered area defined by a width and a length of a vehicle parking space. The supporting structure is configured so as to permit substantially unobstructed access to the sheltered area and viewing of the display area. The receiving device is operable to receive and process a signal including images to be displayed. The signaling path couples the receiving device to the canopy and facilitates communication of the images to the canopy for display in the display area. In an alternative embodiment, the canopy further includes a photovoltaic device capable of producing an electrical current when exposed to a light source, the photovoltaic device supplying energy to operate at least the receiving device and the display area of the canopy.

One skilled in the art will readily understand the numerous advantages and benefits of the present invention. One skilled in the art will also readily recognize that the information shelter depicted in FIG. 13 as a single carport-type shelter may be readily implemented as a multi-carport type shelter as depicted in FIG. 10. The present invention provides the synergistic effect of providing cover from the sun and other natural elements while simultaneously displaying information to at least the users of the shelter. This makes the information display shelter of the present invention well-suited for use in large parking lots at shopping malls, retail outlets, commuter sites and commercial facilities, for example. Parking areas at these locations are typically outdoors and experience high sun exposure. Thus, erecting the inventive information display shelter at such sites would not only provide displayed information, but could also provide an alternate energy source (when including integrated solar panels), and would yield the added benefit of protecting parked vehicles from the elements (i.e., sun, hail and rain, for example), while maintaining the vehicles' interior at a cooler temperature to the favor of vehicle operators departing these sites, as well as illuminate dark areas for safety reasons.

The present era of energy deregulation, rising utility costs and an increased frequency of power outages has increased public awareness of these problems and underscores the need for effective alternate forms of energy generation. Utilized on a large scale, the energy generating shelter of the present invention may significantly reduce the strain on overburdened and aging power grids by supplying power directly to energy consumers adjacent the shelters. Power grid strain may be further reduced by supplying the shelter-generated energy to a nearby utility company for further distribution to other energy consumers. Wide-scale application of the present energy generating shelter may considerably reduce the occurrence of rolling brownouts, blackouts or other problems associated with power grid strain, particularly during peak energy demand periods resulting from, for example, hot sunny days, which are also the types of days when maximum electricity can be produced by photovoltaic devices.

While the invention has been described with respect to certain preferred embodiments, as will be appreciated by those skilled in the art, it is to be understood that the invention is capable of numerous changes, modifications and rearrangements and such changes, modifications and rearrangements are intended to be covered by the following claims.

What is claimed is:

1. A method for providing an electrically powered interactive canopy system and for providing and distributing less obtrusive interactive overhead advertisements in a parking lot, comprising:

providing an improved more efficient interactive information display shelter system, comprising a solid canopy display shelter system, comprising a horizontally configured overhead interactive canopy comprising at least one overhead interactive display panel, where each said overhead interactive display panel is placed over a respective parking space, a supporting structure connected to and supporting said at least one overhead interactive display panel over its respective parking space so as to permit less obtrusive overhead interactivity with said display panel and so as to block light from overhead lighting sources, such that consumers in each said parking space can safely access and interact with the respective at least one overhead interactive display panel for that parking space and the overhead interactive canopy provides improved consumer viewing and interactivity with said at least one overhead interactive display panel, at least a one way receiving device operable to receive and process a signal including information to be displayed via the at least one overhead interactive display panel, a computer network to facilitate advertisements via each said at least one overhead interactive display panel, a server database to store interactive advertisements for distribution to each said at least one overhead interactive display panel, at least a one way signaling path coupling the receiving device to the interactive canopy, and further providing wireless i-casted interactive advertisements to consumers of the interactive canopy, apparatus facilitating communication of information to the canopy for display with and through each said at least one overhead interactive display panel such that consumers can interact and communicate through various hand gesture interfaces, VUI and GUI devices in order to access interactively displayed and wirelessly transmitted Internet web portal advertisements via said interactive canopy, and wherein at least one said at least one interactive display panels is tiltable for better consumer advertisement viewing; and providing a source of electrical power for the electrically powered interactive canopy system and method for providing and distributing less obtrusive interactive overhead advertisements in a parking lot.

2. A method for providing a less obtrusive, safer, electrically powered consumer interactive canopy display and shelter system and for using same, comprising:

providing an electrically powered consumer interactive canopy display and shelter system, comprising a horizontally configured overhead, non-continuous interspersed interactive canopy that is unobtrusively configured so as to provide a safer, consumer accessible overhead interactive canopy that displays advertisements, a supporting structure connected to and supporting the interactive canopy over a sheltered area, the supporting structure configured so as to permit access to the sheltered area, wherein the supporting structure is connected to and supports the downward facing, horizontally configured interactive canopy over a parking space area, thereby reducing overhead lighting obstructivites from above the canopy without significantly obstructing overhead consumer interactivity with the canopy, a computer to network interactive canopy advertisements to said interactive canopy and other interactive canopies, and apparatus for providing wirelessly transmitted interactive advertisements to a consumer of the overhead interactive canopy, such that said consumer can interact with said interactive canopy in place over said consumer's parking space in a parking lot through consumer hand gesture interfaces, VUI, and GUI devices; and providing a source of electrical power for the less obtrusive, safer, electrically powered consumer interactive canopy display and shelter system and method for using same.

3. A method for providing an improved, safer, advertisement and consumer incentivized electrically powered interactive information display shelter canopy system and for using same, comprising:

providing a less obtrusive advertisement and consumer incentivized electrically powered interactive information display shelter canopy system canopy system, comprising an electrically powered consumer interactive unobtrusively configured downward facing interactive advertising canopy located over a parking space, said interactive advertising canopy is solidly configured so as to block light from over head light pole lighting, thus improving and significantly improving consumer interactivity with the interactive advertising canopy, a supporting structure connected to and supporting the interactive advertising canopy over a sheltered area, internet gateway-portal equipment that can showcase and transmit wireless interactive advertisements, and apparatus providing and allowing consumers to interact with displayed and wirelessly transmitted interactive advertising canopy advertisements sent and communicated through hand gesture interfaces, GUI, and VUI communication means and devices, so that a consumer is able to fully interact with overhead unobtrusively displayed and wirelessly transmitted interactive canopy advertisements on said interactive advertising canopy;

providing a source of electrical power for the advertisement and consumer incentivized electrically powered interactive information display shelter canopy system and method for using same; and showcasing, displaying and transmitting incentivized i-casted interactive advertisements that consumers benefit from, by interacting, acknowledging and responding to the i-casted interactive advertisements, in exchange for free or discounted products and services that advertisers and the interactive advertising canopy may offer to consumers of the interactive advertising canopy.

4. A method for providing an improved, safer, advertising based incentivized interactive information display shelter system and for using same, comprising:

providing an improved advertising based incentivized interactive information display shelter system, comprising an electrically powered unobtrusively placed overhead interactive canopy including at least one unobtrusive horizontally configured overhead interactive canopy display panel, a supporting structure connected to and supporting the overhead interactive canopy over a parking space area, wherein the overhead interactive canopy provides unobtrusive consumer viewing of, and interactivity with, the interactive canopy over a parking space while a consumer is parked in said space, enabling the consumer to interact safely with interactive canopy advertisements, at least a one way receiving device operable to receive and process a signal including information to be displayed via the interactive canopy, at least a one way signaling path facilitating communication of wireless interactive advertisements that consumer hand gesture interfaces, GUI and VUI means and devices can interact through to interact with the shelters i-casted advertisements, as a consumer sits in a parked car under the canopy, such that at least one of:

the shelter can display interne based advertisements, the shelter can broadcast wireless Internet web portal advertisements from its gateway portal equipment to consumer user interfaces, an advertiser that showcases interactive advertisements from the interactive shelter canopy can further provide consumers with discounted incentivized products and services that the canopy displays and broadcasts to consumers, the interactive advertisements that are displayed and broadcast to consumers are i-cast incentivized wireless advertisements that consumers of the interactive shelter can interact and benefit from in the form of product and service discounts, consumers can opt-into and interact with the interactive advertisements displayed and wirelessly distributed to consumers of the interactive canopy by accessing the retailers store website, consumers can opt-into and interact with the interactive advertisements displayed and wirelessly distributed to consumers of the interactive canopy by accessing the shelters website, consumers can opt-into and interact with the interactive advertisements displayed and wirelessly distributed to consumers of the interactive canopy by accessing the advertisers website, consumer further benefit from the interactive shelters wireless transmissions as they can interact with the interactive canopy advertisements in the comfort of their own car shaded by the interactive canopy located over a commercial mall parking space, and in exchange for consumers interacting with and through various incentivized products and services that are i-casted interactive advertisements, the consumer benefits from interacting with the incentivized advertisements, which promote discounted and free products and services that the advertisers of the canopy may offer to consumers of the interactive shelter, when they interact with the interactive incentivized advertisements; and providing a source of electrical power for the improved, safer, advertising based incentivized interactive information display shelter system and method for using same.

5. The method of claim 1, wherein the placement of an electrical transparent solar panel, placed inside the interactive display panel, further provides less obstructive viewing of the canopy during the day and further provides an included source of electrical power.

6. The method of claim 2, wherein the placement of electrical transparent photovoltaic panel, making up a section of the interactive canopy, further provides safer viewing of the canopy at night, when exposed to an overhead outdoor parking lot light source and further provides an included source of electrical power.

7. The method of claim 3, wherein placement of an electrical transparent photovoltaic panel, placed above the interactive advertising canopy, further provides less obtrusive interactive canopy advertising light, at night, and further provides an included source of electrical power.

8. The method of claim 4, wherein placement of an electrical transparent photovoltaic panel, integrated into the canopy, further promotes safer artificial canopy lighting and further provides an included source of electrical power.

* * * * *